US007089764B2

(12) United States Patent
Brett

(10) Patent No.: US 7,089,764 B2
(45) Date of Patent: Aug. 15, 2006

(54) METHOD OF ARRANGING FOR A JEWELRY DISPLAY ON AN ADHESIVE BANDAGE

(76) Inventor: Joyce Brett, 166 E. 61st St., New York, NY (US) 10021

( * ) Notice: Subject to any disclaimer, the term of this patent is extended or adjusted under 35 U.S.C. 154(b) by 743 days.

(21) Appl. No.: 10/029,818

(22) Filed: Dec. 31, 2001

(65) Prior Publication Data

US 2003/0121281 A1 Jul. 3, 2003

(51) Int. Cl.
*A44C 27/00* (2006.01)
*A44C 15/00* (2006.01)

(52) U.S. Cl. ..... 63/14.9; 63/14.1; 428/42.1

(58) Field of Classification Search ..... 63/14.9, 63/14; 602/42, 58; 428/42.1
See application file for complete search history.

(56) References Cited

U.S. PATENT DOCUMENTS

| | | | | | |
|---|---|---|---|---|---|
| 4,285,338 | A * | 8/1981 | Lemelson | ..... | 602/58 |
| D340,988 | S * | 11/1993 | Arginsky | ..... | D24/189 |
| D368,526 | S * | 4/1996 | Palermo | ..... | D24/189 |
| D424,202 | S * | 5/2000 | Wilson | ..... | D24/189 |
| 6,255,553 | B1 * | 7/2001 | Sullivan | ..... | 602/58 |
| 6,455,752 | B1 * | 9/2002 | Vesey | ..... | 602/41 |
| 6,472,039 | B1 * | 10/2002 | Amen-Ra A | ..... | 428/42.1 |

* cited by examiner

*Primary Examiner*—Kathryne Micthel
(74) *Attorney, Agent, or Firm*—Myron Amer PC

(57) ABSTRACT

An arrangement of low-cost jewelry objects displayed on the person preliminarily made on a BAND-AID adhesive bandage and transferred to the site of display on the person by being correlated to where the BAND-AID adhesive bandage is attached to the person.

1 Claim, 1 Drawing Sheet

METHOD OF ARRANGING FOR A JEWELRY DISPLAY ON AN ADHESIVE BANDAGE

The present invention relates generally to adhesively applied low-cost jewelry displays, as exemplified by so-called costume jewelry, worn as an adornment directly on the person and, more particularly, to improvements facilitating the adhesive attachment involved in this fashion trend.

EXAMPLES OF THE PRIOR ART

As long as over eighty-six years ago, as exemplified by U.S. Pat. No. 1,140,975 for Beauty Mark" issued to F. Frankel on May 25, 1915, and as recently as less than two years ago, as exemplified by U.S. Pat. No. 6,079,224 for "BODY-WORN ORNAMENT, BODY-WORN ORNAMENT KIT, AND METHOD OF ATTACHING A BODY-WORN ORNAMENT" issued to Schehr on Jun. 27, 2000, patent literature chronicles the fashion trend of directly adhesively applied appearance-enhancing jewelry displays; in another U.S. patent issued in 1980, as U.S. Pat. No. 4,220,016 to Frenger, being even aptly entitled "SKIN JEWELRY." Practicing this fashion trend contemplates manually placing, in sequence, an adhesive deposit at a site of attachment, and an arrangement of display objects, such as rhinestones, in the adhesive deposit, and allotting an appropriate time interval for the curing of the adhesive, among other obvious drawbacks.

Broadly, it is an object of the present invention to provide directly applied "skin jewelry" overcoming the foregoing and other shortcomings of the prior art.

More particularly, it is an object to significantly and effectively simplify implementing the fashion trend by the making of the jewelry display on a support that is currently commercially available and thereafter readily transferred to the selected site of display for attachment on the person, and even using minimum distraction from the jewelry display as well as using to advantage product attributes of the commercially available support to serve the purposes of skin jewelry, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 5:
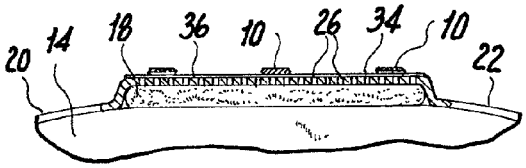
FIG. 5 is a cross sectional view, as taken along line 5—5 of FIG. 4, illustrating further structural details.

A fashion trend currently in practice is to display low-cost objects, such as costume jewelry, in the specific form of rhinestones of glass construction material, individually and collectively designated 10, at select locations on the person 12, such as on her cheek, as noted at 14, and the heretofore unrelated practice of covering minor cuts with a Band-Aid adhesive bandage, generally designated 16, as defined in words or in substance in WEBSTER'S COLLEGE DICTIONARY, and as supplemented by what is known by common experience, as "an adhesive bandage with a gauze pad in the center, used to cover minor abrasions and cuts," having as a commercially available article of manufacture, a central gauze pad 18 with opposite direction left and right extending adhesive strips 20 and 22, wherein the gauze pad 18 has an array, generally designated 24, of plural edges bounding circular openings, individually and collectively designated 26, shown greatly simplified in the cross sectional view of FIG. 5, providing ventilation for a gauze pad-covered injury (not shown). The present invention combines the two noted practices, using to advantage the availability of a Band-Aid 16 to achieve the rhinestone display 10 at the exemplary cheek location 14, as well as at other selected locations on the person 12, as will be better understood as the description proceeds.

For its medical or first aid end use, the central gauze pad 18 has release strips 28 and 30 in overlapping relation, as at 32, beneath the gauze pad 18, each of which is connected to extend from the gauze pad 18 in contact against the adhesive surfaces of the adhesive strips 20 and 22 to thusly neutralize or obviate an adhesive function of the adhesive strips 20, 22 until the BAND-AID adhesive bandage 16 is put to use. While the release strips 28 and 30 are in place, the BAND-AID adhesive bandage 16 is readily handled without difficulty, and the handling contemplates the deposit of a viscous, not yet cured, appropriate adhesive 34, such as an adhesive commercially available from East Coast Labs of Greensboro, N.C., on a top surface covering 36 of the gauze pad 18, from which deposit there is flow in depending relation within the venting openings 26 effective to contribute to gripping engagement of the adhesive deposit 34 to the top or display surface 36.

Before the adhesive cures, i.e., while still in its viscous condition, the rhinestones 10, in a selected display, are placed, either manually or by machine, in adhesive contact with the adhesive 34, resulting in the ultimate adhesive securement of the jewelry display 10 on the BAND-AID adhesive bandage 16.

Figure 1:
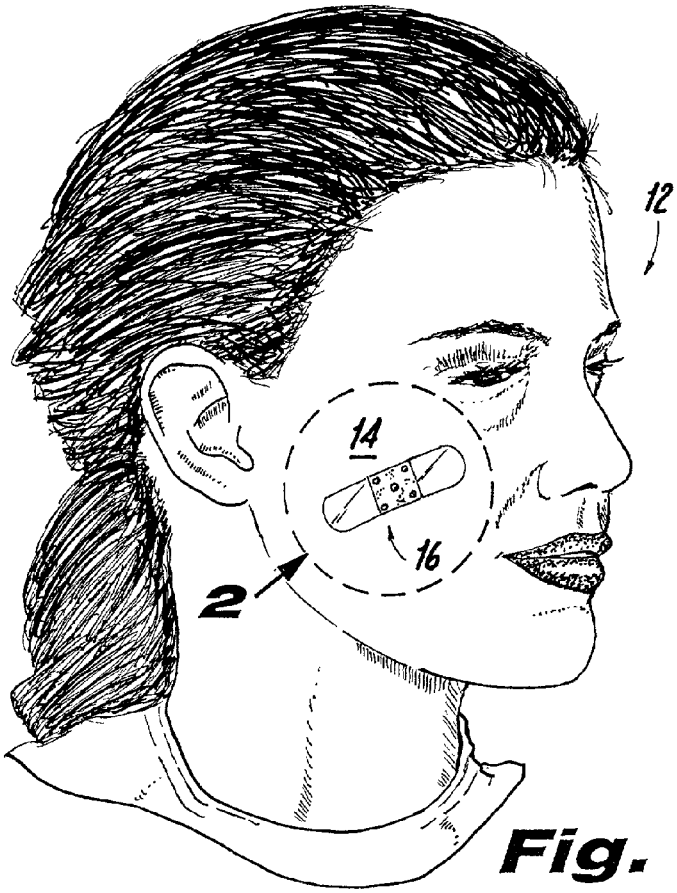
FIG. 1 is a front elevational view of an exemplary facial jewelry display according to the present invention.
Figure 2:
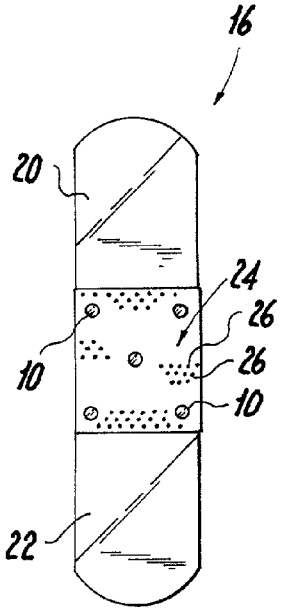
FIGS. 2 and 3 are respectively top and rear isolated views of a Band-Aid adhesive bandage component of the display.
Figure 4:
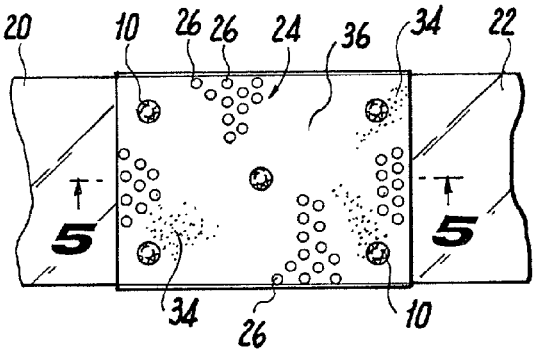
FIG. 4 is a partial top view, on an enlarged scale, illustrating details of the exemplary facial jewelry display of FIG. 1.
Figure 3:
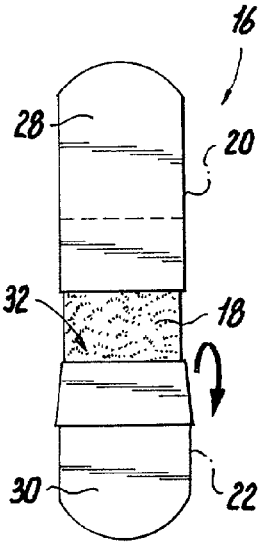

To maximize the display value of the BAND-AID adhesive bandage applied jewelry display 10, use is made of adhesive strips 20 and 22 having clear plastic construction material providing unobstructed visibility therethrough of the skin of the user 12 at the selected site of attachment of the BAND-AID adhesive bandage 16, an aspect noted by the phantom perspective illustration of the strips 20, 22 in FIG. 1, which to a viewer sees the jewelry display 10 in isolated relation apart from the BAND-AID adhesive bandage 16. By eschewing the current practice of manually placing, in sequence, an adhesive deposit at a site of attachment and an arranged rhinestone or like display objects in the adhesive deposit, and allotting an appropriate time interval for the curing of the adhesive, the providing of a jewelry display worn on the person is correlated to the placement of a jewelry-adorned BAND-AID adhesive bandage.

While the BAND-AID applied jewelry display herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of arranging for a jewelry display to be worn on the person at a location on which a cosmetic is typically applied on said person comprising the steps of: using an adhesive bandage having a central gauze pad, using opposite direction laterally extending strips of clear plastic construction material from opposite sides of said central gauze pad, applying a first adhesive deposit on said laterally extending strips on a surface thereof in facing relation to a site of attachment to a user thereof effective for attachment of said adhesive bandage to said user, using overlapping release strips extending beneath said first adhesive deposit for attachment to said strips effective to obviate an adhesive function of said first adhesive deposit on said strips, said central gauze pad being characterized by an outwardly facing display surface in covering relation thereover and having an array of spaced apart edges bounding venting openings in communication with said gauze pad, applying a second adhesive deposit when in a viscous state on said display surface, flowing said second adhesive deposit into said venting openings effective to contribute to gripping engagement of said second adhesive deposit to said display surface, maintaining an overlapping of said release strips beneath said central gauze pad to serve as a closure for said venting openings effective to prevent leakage of said viscous adhesive from said venting openings, applying a rhinestone jewelry display that is adhesively secured to said display surface of said central gauze pad, allowing a curing of said second adhesive deposit for permanently attaching said jewelry display thereto, and removing said release strips and placing said bandage at a location selected for appearance enhancement, whereby said jewelry is displayed in isolated relation on the person correlated to said site of attachment of said adhesive bandage.

* * * * *